United States Patent [19]

Patterson

[11] 3,997,050

[45] Dec. 14, 1976

[54] JEWELRY CADDY

[76] Inventor: Chad W. Patterson, 619-28th St., Ogden, Utah 84403

[22] Filed: Feb. 17, 1976

[21] Appl. No.: 658,348

[52] U.S. Cl. ..... 206/75; 211/125; 211/131; 211/163

[51] Int. Cl.[2] ..... B65D 1/34

[58] Field of Search ..... 206/75; 211/70, 125, 211/131, 163

[56] References Cited

UNITED STATES PATENTS

| | | | |
|---|---|---|---|
| 3,357,570 | 12/1967 | Hagle, Sr. et al. | 211/125 |
| 3,848,943 | 11/1974 | Geesaman et al. | 206/75 X |

*Primary Examiner*—George T. Hall
*Attorney, Agent, or Firm*—Mallinckrodt & Mallinckrodt

[57] ABSTRACT

A jewelry caddy, which can be used to display jewelry commercially or which can be placed on a dressing table or vanity and used to store jewelry in an easily accessible place, comprises a base structure having an upstanding elongate element rotatively attached thereto. The upstanding element has a plurality of projections extending therefrom which are adapted to hold articles of jewelry. In addition, a layer of material, which can be easily penetrated by a needle or pin covers at least a portion of the surface of the upstanding element, whereby jewelry or other items having pin type attachments can be pinned to the material for convenient display and storage.

6 Claims, 4 Drawing Figures

FIG. 2
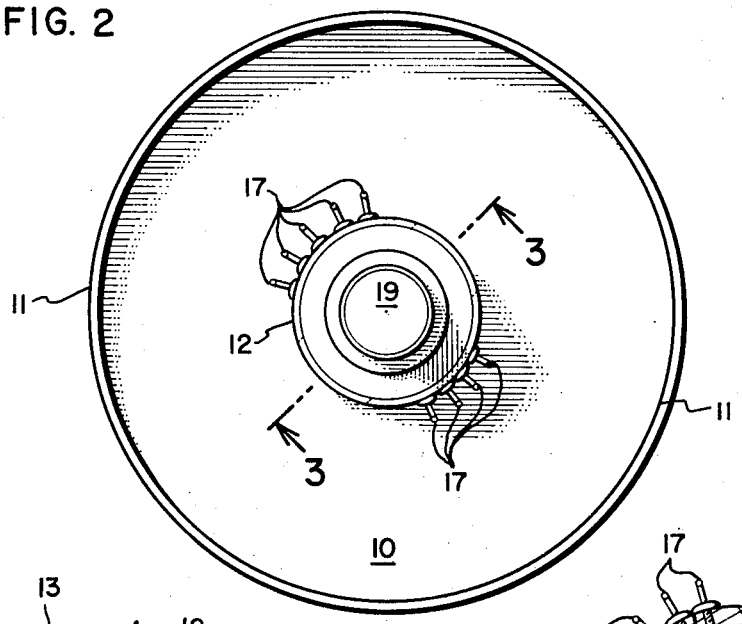
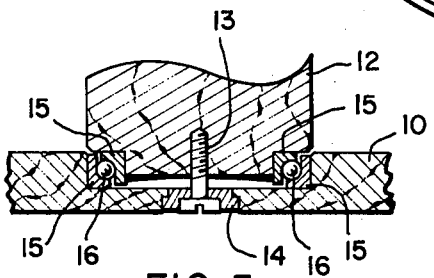
FIG. 3
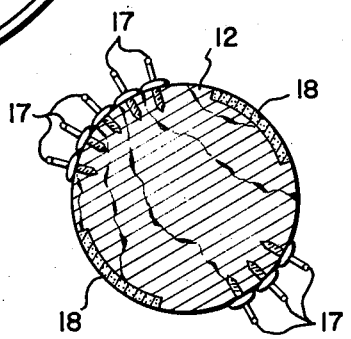
FIG. 4
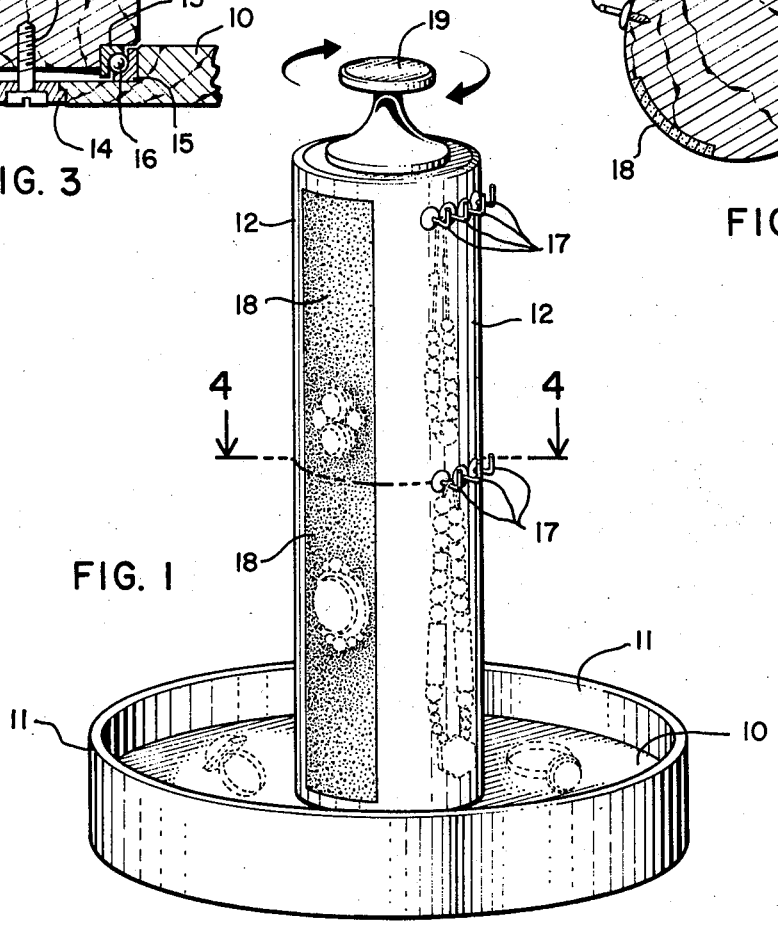
FIG. 1

JEWELRY CADDY

BACKGROUND OF THE INVENTION

1. Field

This invention pertains to jewelry racks used to store and display items of jewelry.

2. State of the Art

A number of different racks have been developed heretofore for commercially displaying jewelry. These racks have generally been found useful only in commercial displays and have not been used by women to store jewelry and other items in their homes. Instead, jewelry boxes and chests have been used for home, storage of jewelry and related items.

In U.S. Pat. No. 3,357,570, issued on Dec. 12, 1967, a rack is contemplated for home storage of cumbersome articles such as hair curlers. The articles are hung from a multiplicity of supports extending radially outward from an upstanding element which in turn is attached to a base structure. The support elements are uniformly distributed about the upstanding element, and the upstanding element is adapted for rotational movement relative to the base structure. Although the rack of U.S. Pat. No. 3,357,570 may be useful for storage of hair curlers and such items, it is not well adapted for storing and displaying a wide variety of jewelry items, such as pins, brooches, rings, bracelets, watches, pendants, and necklaces.

SUMMARY OF THE INVENTION

A jewelry caddy is provided which, in addition to being useful for commercially displaying jewelry, is ideally adapted to be placed on a dressing table or vanity and used to store all types of jewelry in a practical manner. The jewelry caddy of this invention is an attractive accessory to a vanity, dressing table, or chest of drawers, and the jewelry stored thereon is always visible and easily accessible.

In accordance with the invention, the jewelry caddy comprises a base structure and an upstanding, elongate element having a smaller cross-sectional dimension than the corresponding dimension of the base structure. The upstanding element is pivotally attached to the base structure for rotational movement relative thereto. A plurality of support elements extend outwardly from the upstanding element so as to be adapted to hold articles of jewelry.

A layer of material capable of being easily penetrated by a needle or pin covers at least a portion of the surface of the upstanding element. Preferably, the surface of the upstanding element is divided into at least one set of discrete areas. One area in each set is covered, at least partially, with the layer of material and the other area in each set has the support elements extending therefrom. However, the entire surface of the upstanding element can be covered by the layer of material, with the support elements being postioned either in discrete areas about the surface of the upstanding element or over the entire surface in a indiscriminate or uniform matter. In a preferred form, the upstanding element is cylindrical in shape and the surface thereof is divided into two sets of discrete areas, one area in each set having the support elements extending therefrom and the other area in each set being covered, at least partially, with the layer of material. The layer of material can be made of cork and soft woods such as balsa; foamed rubber and foamed organic resins; felt; thick velvet; porous composition board; rubber and elastic organic resins; and other materials which are easily penetrated by a pin or needle. The surfaces of the upstanding element which are covered with the layer of material are advantageously recessed by an amount equal to the thickness of the layer of material, so that the external surface of the layer of material is continuous to the remaining surface of the upstanding element.

Brooches and other jewelry having pin type attachments can be secured to the layer of material on the jewelry caddy by simply pushing the pin of the brooch or other piece of jewelry into the material.

THE DRAWINGS

An embodiment representing the best mode presently contemplated of carrying out the novel concepts of the invention in actual practice is illustrated in the accompanying drawings, in which:

FIG. 1 is a perspective view of the jewelry caddy with several pieces of jewelry shown in phantom attached thereto;

FIG. 2, a top plan view of the jewelry caddy of FIG. 1;

FIG. 3, a partial vertical section taken along line 3—3 of FIG. 2, showing the details of the connection of the upstanding element to the base support; and FIG. 4, a vertical section taken along line 4—4 of FIG. 1.

DETAILED DESCRIPTION OF THE ILLUSTRATED EMBODIMENTS

As illustrated in the drawing, the jewelry caddy has a base structure 10 shown as a circular shaped disc. A rim 11 extends upwardly from the perimeter of the base structure 10, thereby forming a shallow tray in which items of jewelry, such as the two rings shown in phantom in FIG. 1, can be placed.

A cylindrical, upstanding element 12 is connected at one of its ends to the base structure 10 so that the upstanding element 12 can rotate with respect to the base structure 10. In the preferred mode as illustrated in FIG. 3, the base structure 10 has a cylindrical recess therein which is adapted to receive the end of the upstanding element 12. An elongate fastener 13 extends through a bushing 14 in the base structure 10 and is secured to the end of upstanding element 12. The elongate fastener 13 is adapted for pivotal or rotational movement within the bushing 14, so as to allow the upstanding element 12 to rotate relative to the base structure 10. To provide for minimal sliding friction between the upstanding element 12 and the base structure 10, ball-bearing means are positioned therebetween. As shown in FIG. 3, the ball-bearing means comprise a cooperating set of race elements 15, one being attached to the perimeter of the recess in base 10, and the other being attached to the end of the upstanding element 12. A plurality of balls 16 are positioned between the race elements 15.

The cylindrical, upstanding element 12 has a plurality of support elements 17 extending therefrom. The support elements 17 are preferably positioned in separate groups spaced around the upstanding element. As illustrated, there are two general groups of support elements 17 positioned on opposite sides of the upstanding element 12. These two groups of support elements 17 are separated from each other by two areas or sections each of which has a layer of material 18 attached thereto covering at least a portion thereof. As shown, the layers of material extend nearly the full length of the upstanding element 12 and are wide enough to cover the major portion of the surfaces of each of the sections which separate the two groups of support elements 17.

Although the structure illustrated represents the preferred mode, it is to be recognized that the layer of material 18 could cover a larger or smaller portion of the surface of the upstanding element 12 than shown in the drawing. The layer of material could, in fact, cover the entire surface of the upstanding element 12 if so desired. In the preferred mode illustrated, the surfaces of the upstanding element which are to be covered with the layers of material 18 are recessed, as shown in FIG. 4, so that the external surfaces of the layers of material 18 are continuous to the remaining surface of the upstanding element 12. In other words, the layers of material 18 are inlaid in the recesses so that the external surface of the layers of material have the same radius as the remaining surface of the upstanding element.

The layer of material 18 comprises any material which is easily penetrated by a pin or needle. It is advantageously made of cork, soft wood such as balsa, foamed rubber, foamed organic resins, or a soft elastic material such as rubber or elastomeric organic resins. The thickness of the layer of material is not critical. It need only be thick enough that brooches and other items of jewelry having pin type attachments can be secured thereto by pushing the pins of the brooches and other items of jewelry into the layer of material 18. Two items of jewelry are shown in phantom in FIG. 1 attached to the layer of material 18.

As illustrated, the two groups of support elements 17 are separated into two subgroups with one subgroup being located near the top of the upstanding element 12 and the other subgroup being located near the middle of the upstanding element 12. This allows necklaces, watches and other items to be hung from the support elements 17 without hampering the hanging of other items on the remaining support elements. Two necklaces are shown in phantom in FIG. 1 hanging from two of the support elements 17.

A decorative knob 19 is attached to the upper, free end of the upstanding element 12 and is used to manually rotate the upstanding element.

The materials used to make the base structure 10, including the rim 11, and the upstanding element 12 may be selected from readily available materials such as wood, plastics and metals. Mineral material such as onyx and marble could also be used, especially to make the base structure 10. As shown in the drawing, the base structure 10 and the upstanding element 12 are made of solid pieces of wood. If plastics were used in the construction of the jewelry caddy, it would, of course, be feasible to make the upstanding element 12 in the form of a hollow cylindrical casting with end pieces attached at the ends thereof. Making the upstanding element 12 hollow would, of course, save on the amount of plastic material used. It is further contemplated that a light bulb could be placed within the hollow cavity of an upstanding element made of hollow platic casting, so that the jewelry caddy could also be used as a table lamp. Light from the lamp could come from openings in the top of the upstanding element, or through the sides and top thereof when the plastic used is of such a nature as to be translucent or at least only slightly opaque.

The support elements 17 are advantageously made from metal. As shown in the drawing, the support elements 17 consist of heavy gauge wire hooks having threaded engagement ends which are screwed into the wood of the upstanding member 12. If the upstanding member 12 is cast from plastic, the support elements 17 could be cast as an integral part thereof.

It is to be noted that many modification may be made to the jewelry caddy as illustrated herein in addition to those mentioned above. The upstanding element may have cross-sectional shapes other than circular. For example, the cross-section shape could be oval, square, rectangular, pentagonal, hexagonal, etc. Instead of being positioned at the center of the base structure, the upstanding element could be located near the edge thereof, and the base structure could have a shape other than circular, such as oval, square, rectangular, pentagonal, hexagonal, etc. In addition, the upstanding element could be made to rotate around an axis other than its own longitudinal axis. And, the support elements could be placed anywhere on the upstanding element rather than in discrete groups as illustrated. Such modifications may be adopted and other changes may be made without departing from the disclosed inventive concepts which are particularly pointed out in the following claims.

I claim:

1. A jewelry caddy comprising a base structure; an upstanding, elongate element having a smaller cross-sectional dimension than the corresponding dimension of the base structure; means for connecting one end of the upstanding element to the base structure so that the upstanding element can rotate with respect to the base structure; a plurality of support elements extending from the upstanding element, said support elements being adapted to hold articles of jewelry; and a layer of material capable of being easily penetrated by a needle or pin, said layer of material covering at least a portion of the surface of the upstanding element so that jewelry having pin type attachments can be pinned to the material for convenient display and storage.

2. A jewelry caddy in accordance with claim 1, wherein the upstanding element is cylindrical in shape, and the surfaces thereof covered with said layer of material are recessed so that the external surface of said material is continuous to the remaining surface of said upstanding element.

3. A jewelry caddy in accordance with claim 2, wherein the free end of the upstanding element has a decorative knob attached thereto which is used to manually rotate said upstanding element.

4. A jewelry caddy in accordance with claim 1, wherein the base structure has a rim extending upwardly from its edges thereby forming a shallow tray in which items of jewelry can be placed.

5. A jewelry caddy in accordance with claim 1, wherein the upstanding element is cylindrical in shape; the base structure has a cylindrical recess adapted to receive said one end of the upstanding element; and the means for connecting the upstanding element to the base structure comprises an elongate fastener having one end pivotally secured to the base structure and the other end attached to said one end of the upstanding element.

6. A jewelry caddy in accordance with claim 5, wherein ball-bearing means are provided between the base structure and the upstanding element to minimize sliding friction therebetween.

* * * * *